US006364695B1

(12) United States Patent
Watanabe

(10) Patent No.: US 6,364,695 B1
(45) Date of Patent: Apr. 2, 2002

(54) FLAT CIRCUITRY CONNECTOR AND METHOD OF CONNECTING FLAT CIRCUITRIES USING THE SAME

(75) Inventor: Hiroshi Watanabe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/684,909

(22) Filed: Oct. 10, 2000

(30) Foreign Application Priority Data

Oct. 12, 1999 (JP) ..... 11-289591

(51) Int. Cl.[7] ..... H01R 4/24

(52) U.S. Cl. ..... 439/498; 439/410; 439/422; 439/499

(58) Field of Search ..... 439/260, 493, 439/495, 498, 422, 424, 261, 410, 499; 174/94 R, 174 R, 117 F, 117 FF, 84 R, 74 R

(56) References Cited

U.S. PATENT DOCUMENTS

| | | | | | |
|---|---|---|---|---|---|
| 3,514,528 | A | * | 5/1970 | Ray | 174/87 |
| 3,697,925 | A | * | 10/1972 | Henschen | 439/494 |
| 3,715,705 | A | * | 2/1973 | Kuo | 439/422 |
| 4,731,033 | A | * | 3/1988 | Bajohr et al. | 439/410 |
| 4,900,264 | A | * | 2/1990 | Bennett et al. | 439/391 |
| 6,177,635 | B1 | * | 1/2001 | Sugiura et al. | 174/138 |

* cited by examiner

*Primary Examiner*—Renee Luebke
*Assistant Examiner*—L. Tsukerman
(74) *Attorney, Agent, or Firm*—Morgan, Lewis & Bockius LLP

(57) ABSTRACT

Flat circuitries 8, 9 are inserted into a connector body 15. At this time, a metal terminal 19 interposed between the two flat circuitries 8, 9 is held between the flat circuitry 8 and a press member 26 actuated by inserting the flat circuitry 9 into the connector body 15, and a claw 22 bites into conductors 12 of the second flat circuitry 9 to connect the flat circuitries 8, 9 to each other.

7 Claims, 3 Drawing Sheets

FLAT CIRCUITRY CONNECTOR AND METHOD OF CONNECTING FLAT CIRCUITRIES USING THE SAME

BACKGROUND OF THE INVENTION

The present invention relates to a flat circuitry connector used in an automobile, an industrial machine device, or the like, and to a method of connecting flat circuitries using the connector.

Various kinds of electric devices are mounted in a recent automobile provided with a navigation system device, an air bag system, or the like therein, and the number of devices is getting increased. Accordingly, since the number of a wire harness laid in a car body is also increased, from viewpoints of the work performance and effective utilization of a room space, as shown in FIG. 6, a flat circuitry 1 is used, which is formed in a belt-like shape by collecting and laying conductors 2 in an insulating resin.

This flat circuitry 1 is laid in, for example, a component member of an instrument panel, and has some exposure windows 4 for leading out power source (battery in case of an automobile) current therefrom to supply the current to electrically equipped devices. However, since the number of the laid conductors increases as described above, correspondingly, the flat circuitries 1 are laminated (two layers in this case) with adhesive or a connecting member 3.

In a related device, as shown in FIG. 6, in case that the end portion of the flat circuitry 1 is cut off and the power current is taken out from this cut portion, another conductors 5 are electrically connected to the conductors 2 facing to exposure windows 4 on the end portion side, and a metal terminal (not shown) attached to the end portions of the conductors 5 is put into and connected to one side of a connector housing 6. Further, to the other side of the connector housing 6, a metal terminal (not shown) of a harness end portion for electrically equipped devices such as a wiper motor, a running meter, an audio device and the like is connected.

In the above related device, the conductors 2 of each layer are respectively connected to the connector housing 6 through the conductors 5. Therefore, probability that the conductors 5 come into contact with one another becomes high between the conductors 2 and the connector housing 6. Further, within the connector housing 6, there are two contact points with the metal terminal on the conductor or electrical conductor 5 side and with the metal terminal of the harness on the electrically equipped device side. Therefore, the larger the number of the contact points results that reliability of connection lowers.

SUMMARY OF THE INVENTION

The present invention has been made in view of the above circumstances, and its object is to obtain a flat circuitry connector in which connection of flat circuitries can be readily performed in a state where flat faces of the flat circuitries are opposed to each other.

In order to achieve the above object, according to the present invention, there is provided a connector for electrically connecting a plurality of belt-like flat circuitries in which conductors are enclosed in an insulating material body provided with windows for partially exposing the conductors, comprising:

a connector body provided with a through hole into which the plural flat circuitries are inserted such that at least one window on the respective flat circuitries are accommodated therein;

a conductive terminal member provided inside of the connector body so as to be interposed between the flat circuitries for electrically connecting the conductors exposed from the windows of the respective flat circuitries with each other; and a press member for providing an urging force to keep the electrical connection of the conductors of the respective flat circuitries established by the terminal member.

According to the configuration, the electrical connection of the flat circuitries can be directly and readily realized without providing individual members. Therefore, reliability in the connection can be improved.

Preferably, the terminal member is attached to the connector body so as to be movable like a seesaw about the attached point as a fulcrum.

According to the configuration, since the terminal member is movable in accordance with the insertion of the flat circuitries, the inserting operation can be facilitated.

Preferably, the press member includes a first rotatable press member disposed in the vicinity of a first longitudinal end of the terminal member and a second press member disposed in the vicinity of a second rotatable longitudinal end of the terminal member. The rotation of the first press member establishes the electrical connection between the first longitudinal end of the terminal member and the conductor exposed from the window on a first flat circuitry. The rotation of the second press member establishes the electrical connection between the second longitudinal end of the terminal member and the conductor exposed from the window on a second flat circuitry.

According to the configuration, since the electrical connection can be kept by urging forces provided by the first and second press members, the reliability of the connection can be further enhanced.

Preferably, a claw member is provided on each longitudinal end of the terminal member, which bites into the associated conductor.

According to the configuration, the reliability of the connection can be further enhanced.

Preferably, the connector body includes therein a step portion against which an end portion of one flat circuitry is abutted. The first flat circuitry is held between the step portion and the first longitudinal end of the terminal member. The second press member has a body shaped into an eccentric cam for urging the second flat circuitry toward the second longitudinal end of the terminal member by the rotation thereof.

According to the configuration, the reliability of the connection can be further enhanced.

Preferably, the seesaw movement of the terminal member and the rotation of the press members are configured such that both longitudinal ends of the terminal members establish the electrical connection with the associated conductors by passing the second flat circuitry through the through hole of the connector body.

According to the above configuration, since the electrical connection between the flat circuitries can be easily established only by inserting both flat circuitries into the connector body and passing the second flat circuitry therethrough.

DETAILED DESCRIPTION OF THE PREFERRED EMBODIMENTS

One preferred embodiment of the invention will be described below with reference to FIGS. 1 to 5.

Figure 1:
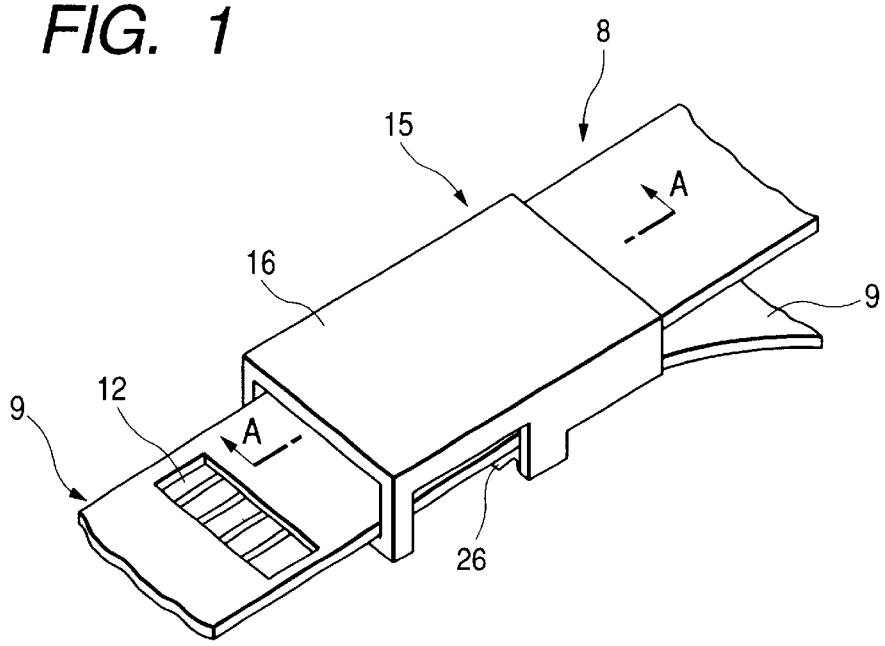
FIG. 1 is a schematic perspective view of an exterior in a flat circuitry connector according to one embodiment of the invention.
Figure 2:
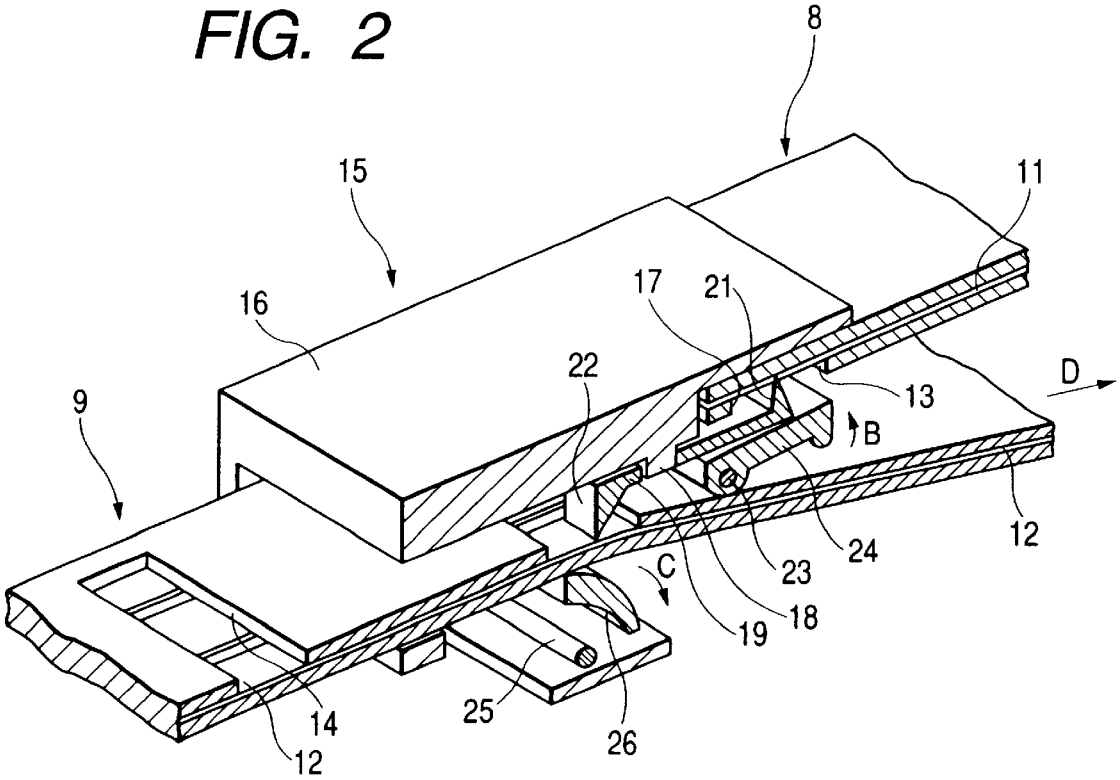
FIG. 2 is an enlarged perspective view of the exterior, viewed from a section taken along a line A—A in FIG. 1.
Figure 3:
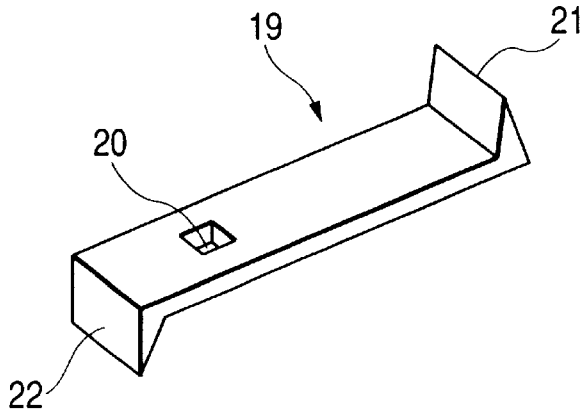
FIG. 3 is an enlarged perspective view of an exterior of a terminal.

FIG. 1 is a schematic perspective view of an exterior in a flat circuitry connector; and FIG. 2 is an enlarged perspective view of the exterior, viewed from a section taken along a line A—A in FIG. 1.

First, reference numeral 8 represents a first flat circuitry and reference numeral 9 represents a second flat circuitry. These circuitries are made of insulating resin material such as a film and formed in the flat shape, in which plural conductors 11, 12 of which each section is flat are collected (in this embodiment, five conductors) and embedded. Further, since each circuitry has proper flexibility, it can be deformed according to the shape of the attaching portion and can be laid there. Exposure windows 13 (14) from which the conductors 11(12) are exposed outside are provided at the proper positions in the longitudinal direction of the flat circuitry 8 (9), and they enable the battery current to divide.

Next, a connector body 15 will be described. The connector body 15 utilizes the principle of a buckle for fastening a belt. First, a housing 16 of the connector body 15 is formed of synthetic resin body, and formed in the shape of a tunnel so as to surround the flat circuitries 8, 9. Within the housing 16, there is provided a step portion 17 against which the left end portion of the first flat circuitry 8 is to be abutted and held thereat. A rectangular projection 18 is formed on a ceiling 16' of the housing 16, and fitted in a substantially rectangular hole 20 formed in a metal terminal 19 shown in FIG. 3, whereby the terminal 19 can move like a seesaw. At the both ends of the terminal 19, wedge-shaped blades, that is, claws 21, 22 are formed. When the flat circuitries 8, 9 are accommodated in the housing 16 so as to be faced with each other, the claws 21, 22 of the terminal 19 provided in positions corresponding to the conductors 11, 12 bite into the corresponding conductors 11, 12, so that electrical connection can be realized.

Further, inside the housing 16, a press member 27 comprising a first press member 24 rotating about a shaft 23 and a second press member 26 rotating about a shaft 25 is formed. The first press member 24 rotates in the counterclockwise direction (direction shown by an arrow B) so as to press the terminal 19 from the downside, whereby it can cause the claw 21 to bite into the first flat circuitry 8 side. The second press member 26 has a circuitry press member for pressing a lower face of the flat circuitry 9, which is formed in the shape of an eccentric cam, that is, in the shape of a fan; and a dimension from the shaft 25 to the cam face is set to becomes longer as the second press member 26 rotates clockwise, so that the second press member 26 is formed so that the pressing force increases. When the second flat circuitry 9 moves to the right (in the direction shown by an arrow D in FIG. 2), the second press member 26 is rotated in the direction of an arrow C by frictional force between the flat circuitry 9 and the second press member 26; and the second flat circuitry 9 is lifted upward, so that the conductors 12 are bitten into the claw 22.

As shown in FIG. 2, in order to electrically connect the first and second flat circuitries 8, 9 to each other inside the housing 16 of the connector body 15 through the terminal 19, the following manner is adopted.

Figure 4:
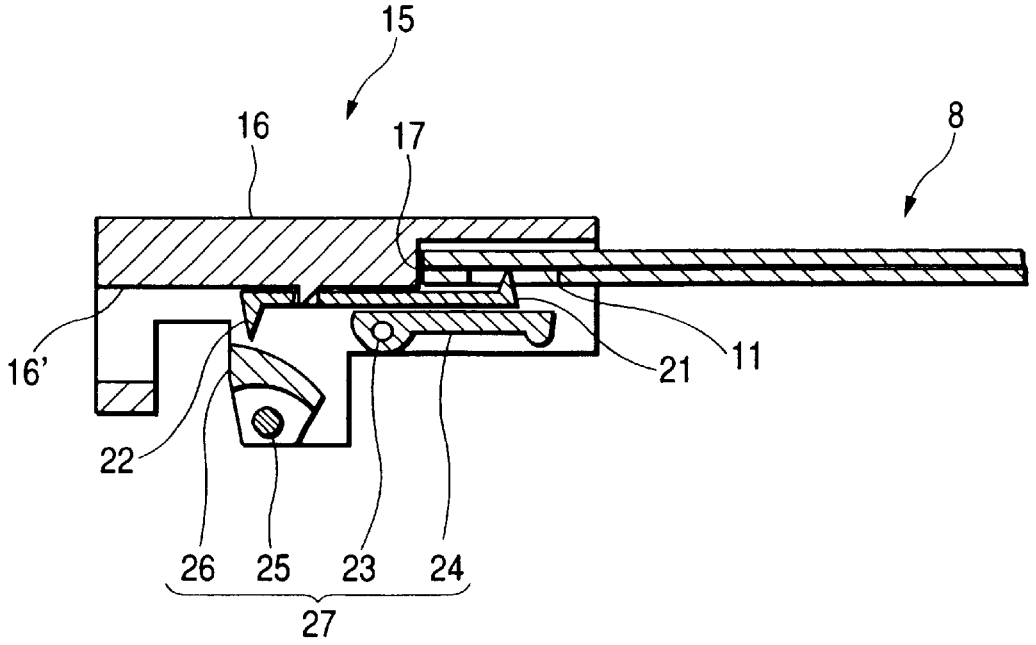
FIG. 4 is a sectional view for explaining an operation of the connector, in which a state where a first flat circuitry is attached to a connector body.
Figure 5:
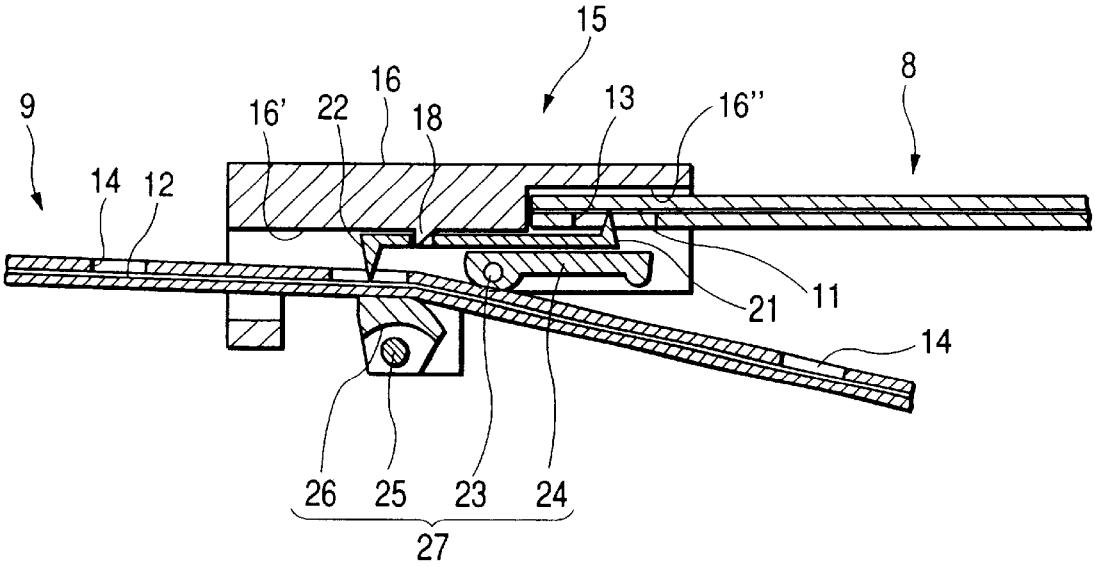
FIG. 5 is a sectional view for explaining the operation, in which a state where a second flat circuitry is attached to the connector body.
Figure 6:
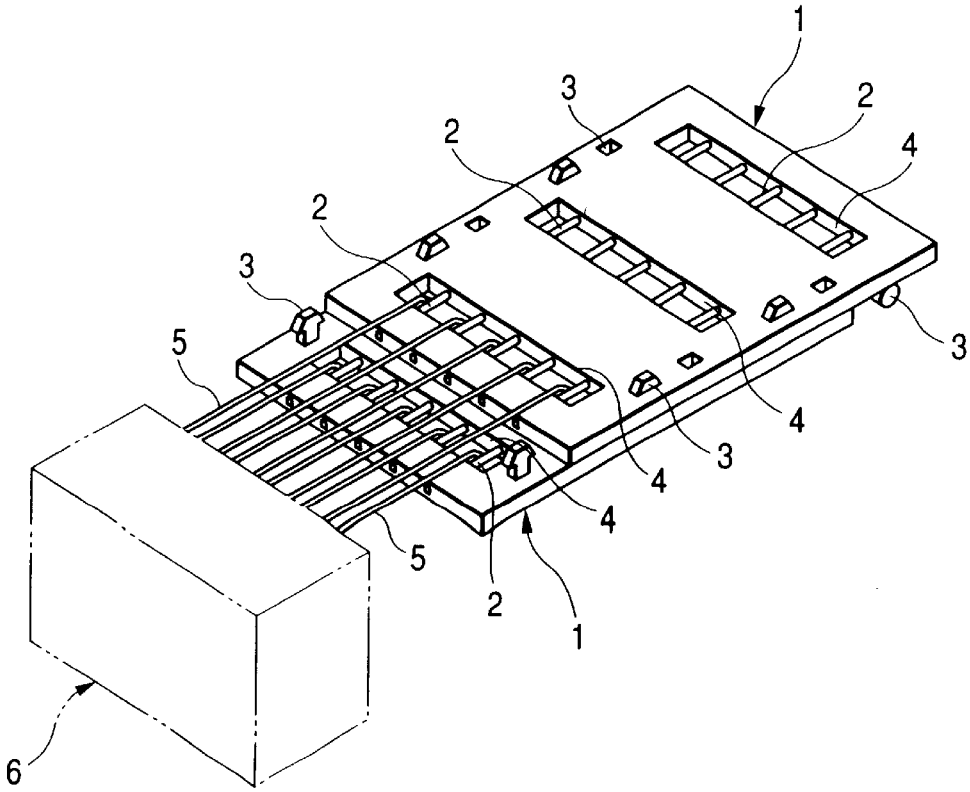
FIG. 6 is an exterior perspective view of a related connector.

Namely, as shown in FIG. 4, first, the first flat circuitry 8 is inserted into the housing 16 till it comes into contact with the step portion 17. At this time, the first press member 24 is counterclockwise rotated about the shaft 23 from the downside, thereby to cause the claw 21 to bite into the conductors 11 in the exposure window 13. In this state, the second flat circuitry 9 is inserted into the housing 16 from the left so as to be opposite to the first flat circuitry 8 as shown in FIG. 5. At this time, the second flat circuitry 9 is inserted therein so that the terminal 19 and the first press member 24 are arranged above the second flat circuitry 9 and the second press member 26 is arranged below the second flat circuitry 9. Further, the second flat circuitry 9 is inserted therein until the exposure window 14 of the second flat circuitry 9 is opposed to the corresponding claw 22. Hereby, the flat circuitries 8, 9 are incorporated into the connector body 15 and electrically connected to each other through the terminal 19.

The operation of the above flat circuitry connector will be described. As shown in FIGS. 2 and 5, the claw 21 bites into the conductors 11 of the first flat circuit 8 through the first press member 24. At this time, the terminal 19 tilts slightly to the upper right. Then, the second flat circuitry 9 is inserted. Since the peripheral face of the shaft 23 of the first press member 24 frictionally comes into contact with the upper face of the second flat circuitry 9, the first press member 24 continues to be rotated slightly in the counterclockwise direction together with the leftward displacement of the flat circuitry 9, and the claw 21 continues to keep the biting state. On the other hand, the second press member 26 comes into frictional contact with the lower face of the flat circuitry 9 thereby to be about to rotate clockwise together with the rightward displacement of the second flat circuitry 9. Then, the second flat circuitry 9 is held between the second press member 26 and the claw 22, and further the second press member 26 continues to rotate in the direction of the arrow C due to the rightward displacement of the second flat circuitry 9, so that the upper face of the metal terminal 19 comes into contact with the ceiling 16' of the connector body 15. In this state, the claw 22 keeps being bitten into the conductors 12 of the second flat circuitry 9. Namely, the rectangular hole 20 in the terminal 19 comes into contact with the projection 18, whereby the rightward displacement of the second flat circuitry 9 is restricted. At this time, the upper face of the terminal 19 comes into contact with the above ceiling 16' due to the upward pressing force given by the second press member 26. And, the location where the second press member 26 comes into contact with the lower face of the second flat circuitry 9 and presses the circuitry 9 upward is a part corresponding to the exposure window 14, which is located leftward of the claw 22 of the terminal 19. At this time, the exposure window 14 is deformed by the second press member 26 so as to be curved slightly upward. Thus, the conductors 12 keep biting between the claw 22 and the second press member 26 to keep the balance. Further, at this time, in the state where the upper face of the first flat circuitry 8 comes into contact with the ceiling 16' of the connector body 15, the claw 21 bites into the conductors 11. Thus, while the state where the strong biting coupling is being kept, the connection between the conductors 11 of the flat circuitry 8 and the conductors 12 of the flat circuitry 9 can be reliably realized through the terminal 19.

Thus, the flat circuitries 8, 9 are electrically connected to each other by the terminal 19 and the press member 27.

According to the above configuration, the electrical connection can be readily achieved by putting the second flat circuitry 9 between the terminal 19 of the connector body 15 of which the claw 21 previously bites into the first flat circuitry 8 or the first press member 24, and the second press member 26 from the left direction. Further, without using another conductors, a flat circuitry connector having higher reliability of connection can be obtained.

Further, according to the method in this embodiment, only by inserting the second flat circuitry 9 into the connector body 15 later, the flat circuitries can be readily connected to each other on the way without using another conductors or electric conductors, so that the connection work is facilitated.

The embodiment of the invention has been particularly described above, and the concrete configuration cannot be limited the above. The design may be changed within a range not deviating from a subject matter of the invention.

For example, though the press member 27 for connecting the terminal 19 to the flat circuitries 8, 9 is composed of the first press member 24 and the second press member 26, a spring member utilizing the spring force may be used instead. Namely, the conductors of the flat circuitries 8, 9 may be energized by the spring force of the spring member in such a manner that the claws 21, 22 of the terminal 19 are always pressed on, comes into pressure contact with or bite into the conductors of the flat circuitries 8, 9. Further, though each flat circuitry has a single layer structure, the invention can be also applied to a multi-laminated (two-laminated or three-laminated) flat circuitry. Further, though the flat circuitry has the embedded-in-resin structure, there may have a covered-with-film structure. Further, though the exposure windows 13, 14 are formed on one side of each flat circuitry, they may be through-holes which pass through the upper and lower faces of each of the flat circuitries 8, 9. Further, though the end portion of the first flat circuitry 8 is brought into contact with the step portion 17 of the connector body 15, needless to say, it may be laid so as to pass through the connector body 15 in the right and left direction similarly with the second flat circuitry 9. Further, the section of each of the conductors 11, 12 may be circular.

What is claimed is:

1. A connector for electrically connecting a plurality of belt-like flat circuitries in which conductors are enclosed in an insulating material body provided with windows for partially exposing the conductors, comprising:

a connector body provided with a through hole into which the plural flat circuitries are inserted such that at least one window on the respective flat circuitries are accommodated therein;

a conductive terminal member provided inside of the connector body so as to be interposed between the flat circuitries for electrically connecting the conductors exposed from the windows of the respective flat circuitries with each other, wherein the terminal member is pivotally fitted on a projection of the connector body; and at least one press member for providing an urging force to keep the electrical connection of the conductors of the respective flat circuitries established by the terminal member.

2. The connector as set forth in claim 1, wherein the terminal member is movable like a seesaw about the projection.

3. The connector as set forth in claim 2, wherein the at least one press member includes a first rotatable press member disposed near a first longitudinal end of the terminal member and a second press member disposed near a second rotatable longitudinal end of the terminal member;

wherein the rotation of the first press member establishes the electrical connection between the first longitudinal end of the terminal member and the conductor exposed from the window on a first flat circuitry; and wherein the rotation of the second press member establishes the electrical connection between the second longitudinal end of the terminal member and the conductor exposed from the window on a second flat circuitry.

4. The connector as set forth in claim 3, wherein a claw member is provided on each longitudinal end of the terminal member, which bites into the associated conductor.

5. The connector as set forth in claim 3, wherein the connector body includes therein a step portion against which an end portion of one flat circuitry is abutted;

wherein the first flat circuitry is held between the step portion and the first longitudinal end of the terminal member; and wherein the second press member has a body shaped into an eccentric cam for urging the second flat circuitry toward the second longitudinal end of the terminal member by the rotation thereof.

6. The connector as set forth in claim 3, wherein the seesaw movement of the terminal member and the rotation of the press members are configured such that both longitudinal ends of the terminal members establish the electrical connection with the associated conductors by passing the second flat circuitry through the through hole of the connector body.

7. The connector as set forth in claim 1, wherein the connector body is made of an insulative material.

* * * * *